US006023875A

United States Patent [19]

Fell et al.

[11] Patent Number: 6,023,875

[45] Date of Patent: Feb. 15, 2000

[54] TACTICALLY ADVANCED COMBAT MOUNT (TACM III ™) ILLUMINATING DEVICES AND ILLUMINATING MOUNTING SYSTEMS FOR FIREARMS AND OTHER APPLICATIONS

[76] Inventors: Mark Kevin Fell, 1070 Big Horn Cir. NW; Michael Jon Squillante, 1353 Unter Av NW, both of Palm Bay, Fla. 32907

[21] Appl. No.: 08/543,276

[22] Filed: Oct. 16, 1995

[51] Int. Cl.[7] ..... F41G 1/35; F41G 1/36

[52] U.S. Cl. ..... 42/103; 362/114

[58] Field of Search ..... 42/103; 362/110, 362/113, 114

[56] References Cited

U.S. PATENT DOCUMENTS

| | | | |
|---|---|---|---|
| 1,826,004 | 10/1931 | Key . | |
| 4,348,716 | 9/1982 | Storm et al. | 362/110 |
| 5,167,446 | 12/1992 | Haroutunian | 362/110 |
| 5,177,309 | 1/1993 | Willoughby et al. | 42/103 |
| 5,557,872 | 9/1996 | Langner | 42/103 |
| 5,560,703 | 10/1996 | Capps, III | 326/110 |

*Primary Examiner*—Stephen M. Johnson

[57] ABSTRACT

A lightweight illumination source and illumination mount system consisting of an illumination device that may be a small flashlight or laser, and a mount that can be detachably secured to a family of firearms, namely pistols, revolvers, and long guns. The illuminating system, consisting of flashlight and mount, may be attached to the base of a pistol grip by removing the floor plate from the pistol's magazine and installing the mount in place of the original magazine floor plate. The magazine's spring seat(insert) locks the mount in place. Another variation of the invention may be mounted to the butt of a revolver. The resulting Integrated Weapon/Illuminating System provides the user the capability to simultaneously activate the illuminating device while using a standard two handed grip on the firearm, and if the need arises, the capability to operate both light and gun with one hand, while performing other tasks such as finding a light switch, making a phone call, etc. With the mount attached to the grip or butt of the weapon, the firearm can be stored in any standard holster when not in use. Changing magazines restores a pistol to its factory-original condition without leaving a trace that an illuminating system was ever mounted to the gun. The mount may also be configured to support any laser having a ½ inch diameter. Another variation of the mount may be secured to the barrel of any long gun, such as a 12 gauge shotgun, or any other device, such as, but not limited to, binoculars, scopes, etc. that may have a ¾ inch to 1¼ inch diameter. The flashlight may have either a remote pressure switch, which is secured to the firearm by hook and loop (Velcro) fasteners, or a turn/push switch configuration. The flashlight may also be used independently from the firearms mounting systems. The mount may also accept any flashlight the user may have that is 1 inch in diameter.

4 Claims, 7 Drawing Sheets

TACTICALLY ADVANCED COMBAT MOUNT (TACM III ™) ILLUMINATING DEVICES AND ILLUMINATING MOUNTING SYSTEMS FOR FIREARMS AND OTHER APPLICATIONS

BACKGROUND OF THE INVENTION

1. Field of the Invention

The present invention relates generally to attachments or accessories for firearms, and more particularly to auxiliary sighting illumination aids (such as a flashlight or laser) and mounting devices for semi-automatic pistols; and more specifically, to the mounting of an auxiliary light beam aiming device to a pistol, but which may also be applied to other forms of firearms use, or to non-firearms applications such as sport, hunting, or diving activities where aiming or spotting type of illumination assistance is required.

2. Description of Related Art

As pointed out in U.S. Pat. Nos. 4,894,941 and 5,167,446, Law Enforcement Officers in the United States, and in many other countries, are required to carry a flashlight and a firearm, typically a handgun, such as a pistol. Law Enforcement Officers in both the United States and Europe are taught to fire their handguns using a two-handed grip on the gun, known as the 'Weaver' stance and its variations. During day light hours, or in well lit areas, the two-handed grip method presents no problems to gun usage and target identification; however, in dimly lit or darkened conditions, it is difficult, if not impossible to aim a gun correctly while at the same time trying to illuminate the target area in order to identify a potential target, as U.S. Pat. Nos. 4,542,447, 4,758,933, 4,894,941, and 5,167,446 point out. Target identification in dimly lit environments has, in the past, resulted in sacrificing the proper two handed grip method for the method of holding a light in one hand, away from the body, and the handgun in the other. The problems with using this old method are many. First, there is the inconsistency in training, requiring the shooter to master two different forms of shooting (day-type two-handed shooting and night-type one handed shooting). Many Law Enforcement Officers have enough problems mastering one, let alone two different types of shooting techniques. Second, the old method makes it nearly impossible to shoot and move with any reliable degree of accuracy. Another problem that Law Enforcement Officer's constantly face, is the inability to effectively and safely conduct a building search while both hands are tied up with a firearm and a flashlight.

There are also physiological problems encountered when using the old method. These problems result from human beings being asked to split their attention, and command their body to complete two separate gross motor functions (holding a light at the proper angle with one hand and controlling a handgun with the other), and two separate fine motor functions (activating the light and aiming the handgun). There is a known phenomenon that all humans experience which is referred to as sympathetic motor function. Basically, when one hand, or leg, exerts force, the other hand, or leg, will sympathetically exert a lesser force. This is a very basic definition, but it serves as an example that Law Enforcement Officers run the risk of experiencing an unintentional discharge of their weapon when they are trying to complete two separate functions with each hand.

Not only are Law Enforcement Officers confronted with the problem of target identification in dimly lit or darkened conditions, but so are hundreds of thousands of home owners and other people who own hand guns, as U.S. Pat. No. 4,348,716 points out. Therefore, safety for all gun owners is an important consideration for having a gun mounted light system.

It is not a new concept to attach to handguns auxiliary sighting aids such as devices capable of generating a light beam. For over eighty-five years, proposals have been made for auxiliary sighting aids for firearms using light beams or light spots on targets, as has been pointed out in U.S. Pat. Nos. 4,777,754 and 4,856,218. When the light is mounted on the firearm, not only can the proper two handed grip be maintained, but the second hand can be freed up to perform many other functions when the need occurs, such as safely opening a door, looking under a bed, checking out an attic, finding a light switch, using a handrail if moving along a dark stairway, or using the radio or telephone to call for back up or help, to name a few, without sacrificing the advantage of having a light source available.

U.S. Pat. Nos. 4,777,754 and 4,856,218 list a series of U.S. Patents that address patents that propose clamping a flashlight or incandescent lamp with lens, reflectors, on/off switches, trigger switches, and external or internal batteries to a handgun.

With the advent of lasers and infrared systems, patents such as U.S. Pat. Nos. 4,777,754, 4,856,218, 5,042,186, and 5,056,254, and the multitude of patents they refer to, have been issued. All laser systems however, have one basic problem, that is, they all fail to project a beam that allows the capability to illuminate and identify a potential target.

Target identification requires a device, such as a flashlight, with a beam that concentrates on the general target area while having the capability to highlight surrounding areas. Once the target has been located, then laser devices can be used. In other words, a flashlight device is needed to complement the laser, whereas a flashlight does not require a laser device to complement its ability to locate and identify a target. A laser device is useless unless the target has been already identified.

Other methods of attaching laser or flashlight aiming devices, such as U.S. Pat. Nos. 4,777,754, 5,042,186, and 5,056,254 address, and the multitude of patents that each references, requires the user to have an extensive knowledge of firearms, as U.S. Pat. Nos. 4,894,941 and 5,042,186 point out, in order to install the devices.

Other problems presented by some of the previous inventions are the weight of the attachment and illuminating device, and the ability to easily attach and use the target illuminating device, as pointed out by U.S. Pat. No. 4,542,447.

A problem common to all the inventions addressing the attachment of a flashlight and flashlight mounting device to a firearm, and in particular, to a handgun, is that the user cannot use the standard holster that may have come with the firearm. The user is therefore forced into either buying a new holster, or having the existing holster modified in order to safely house the newly mounted flashlight weapon system.

Our invention compensates for and/or corrects all of the problems addressed, inferred, or caused by all the inventions referred to in the above related art, or the inventions referenced to in the above related art.

SUMMARY OF THE INVENTION

It is the general object of this invention to overcome disadvantages and satisfy needs expressed or implicit in the preceding information Description of related art or in other parts hereof.

It is a germane object of this invention to provide a lightweight flashlight and flashlight mounting system for firearms that allow the use of the firearm and flashlight simultaneously, while allowing the capability of maintaining a conventional two-handed grip on the weapon.

It is also a germane object of this invention to provide a lightweight flashlight and flashlight mounting system for firearms that will allow the use of a standard holster for each firearm it is used on or attached to.

It is also a related object of this invention to make a flashlight and flashlight mounting system that can be installed on or attached to any firearm without requiring modifications to be made to the firearm to accept the installation.

It is a related object of this invention to provide a lightweight flashlight and flashlight mounting system for firearms that is of relatively moderate cost.

It is a related object of this invention to provide a lightweight flashlight and flashlight mounting system for firearms, and in particular, for pistols, that provides a multitude of mount configurations that will allow the flashlight mount to be installed in place of a pistol's original O.E.M. magazine floor plate, regardless of whether the pistol's magazine may have an outside or an inside flange into which the mount will be installed as the replacement magazine floor plate.

It is a related object of this invention to provide a lightweight flashlight and flashlight mounting system for firearms, and in particular for revolvers, that may be mounted to the butt of the firearm.

It is also an object of this invention to provide a lightweight flashlight and flashlight mount for guns having long barrels, such as shotguns and rifles.

It is also an object of this invention to provide a flashlight having available two switch configurations, namely a remotely actuated pressure switch and a locally activated turn/push switch.

It is also a related object of this invention to provide a flashlight with a lens assembly that will provide an intense brilliant bright white light beam capable of temporarily blinding any living object that the beam is pointed at in order to give the flashlight user the advantage of time to identify the object and made the determination if that object is a threat or not.

It is also a related object of this invention to provide a flashlight that can be removed from the firearm flashlight mount configuration and be used independent of any firearm mounting system.

It is also a related object of this invention to provide a flashlight that is water proof so that it can be used underwater when using the turn/push switch configuration, and water resistant when using the remote switch configuration.

It is also a related object of this invention to provide a flashlight that can be attached to a broad array of devices, such as police batons and poles used dog catchers, when using the turn/push switch configuration.

Accordingly, the invention provides a lightweight flashlight and flashlight mounting system capable of being mounted to an extremely wide family of firearms, namely pistols, revolvers, shotguns, rifles, and other long barreled firearms, and with the following characteristics: no modifications required to install any flashlight mount, the ability to provide accurate light beam alignment with the firearm sights and barrel, the ability for the flashlight to be operated separately as a flashlight, the ability that the flashlight and flashlight mount system can be quickly removed from the firearm and the firearm used as a standard weapon, and the ability for the flashlight to be easily disassembled and reassembled for fast and efficient replacement of failed components such as the light bulb, batteries and the like.

There are several embodiments of the flashlight mount portion of the invention. In one embodiment, the mount interface may be configured to fit the family of pistols whose magazine floor plate interface has an outside flange. In another embodiment, the mount interface may be configured to fit the family of pistols whose magazine floor plate interface has an inside flange. The magazine spring seat (insert) used by the magazine's manufacturer to lock the original O.E.M. magazine floor plate in place is also used in the same manner to lock all mount embodiments of the invention to the magazine. In still another embodiment, the mount may be configured to fit the barrel of a family of long barreled firearms. Within the pistol category are such pistols as the Glock 17, 18, 19, 20, 21, 22, 23, Smith & Wesson 4506 & 5906, Beretta P92/96, Sig Sauer P226, P228, P229, Ruger P85 & P89, HK USP, and Colt 1911 (with Wilson magazine). It should be understood that this list is not intended to be an all-inclusive list; rather, it is intended to be exemplary and to demonstrate that both U.S. and foreign manufacturers produce pistols which are capable of utilizing the invention described herein. In all of the handguns to which this invention may be applicable, it would be accurate to say that the flashlight and flashlight mount system, when installed, permit the user to use any holster that the user prefers, and no new or modified holster is required to safely holster the weapon.

The flashlight portion of the invention has several embodiments. In one embodiment, the flashlight may be of the form that uses a flat, rectangular-shaped, plastic, enclosed pressure switch incorporating a pair of contacts whose design forces the contacts apart, so that manual pressure is required to be applied to the switch in order to engage the contacts and close the circuit to operate the flashlight. The pressure switch is attached to the end cap of the flashlight by an electrical wire pair. Another embodiment may be of the form that uses a switch built into the end cap of the flashlight and which is activated by either turning the end cap fully clockwise until the internal contact in the end cap closes the circuit and operates the flashlight; or after completing the above activation sequence, the end cap is backed off a quarter of a turn in the counter clockwise direction, which opens the circuit and turns the flashlight off, and then touching the end cap anywhere on its surface, will close the circuit and turn on the flashlight.

Thus any firearm such as a pistol, revolver, shotgun, rifle or other long barreled firearm, when using this invention, can be transformed into an integrated light supported weapon system that will allow the user the capability to identify a potential target before firing, thus possibly preventing an accidental shooting from occurring, and if necessity to shoot arises, will provide the user with an illuminated zone for projectile impact.

The invention and its various objects and attributes will become more readily apparent from the following detailed descriptions and drawings, wherein like numbers refer to like parts throughout.

DETAILED DESCRIPTION OF THE DRAWINGS

Figure 1:
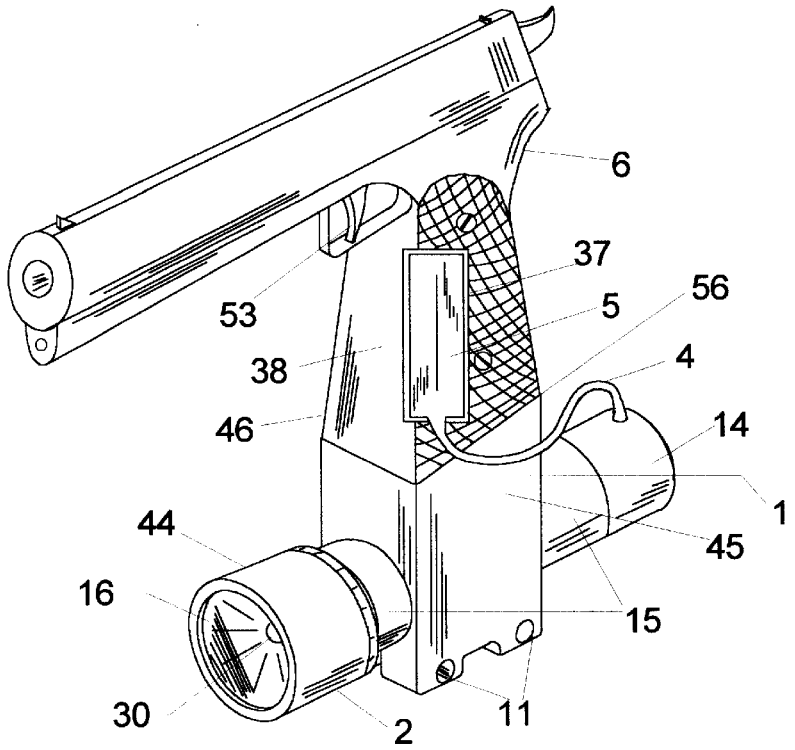
FIG. 1 is a top, front, left side perspective view of a pistol upon which has been installed an embodiment of the invention.

FIG. 1 shows the illuminating system 45 consisting of a mount 1 and flashlight 44 in one of the illustrated preferred embodiments of the invention, mounted to the base of the hand grip 38 of a pistol 6, with a remote pressure switch 5 attached to the pistol grip 38 by hook and loop Velcro 37, and connected to the flashlight 44 by a wire 4 thereby resulting in an Integrated Weapon/Illuminating System 46. The location of the remote pressure switch 5 is dictated by user convenience in operating the switch. Other locations that may be considered for attaching the remote pressure switch 5, using the hook and loop Velcro 37, are the mount 1 or the flashlight 44.

Figure 2:
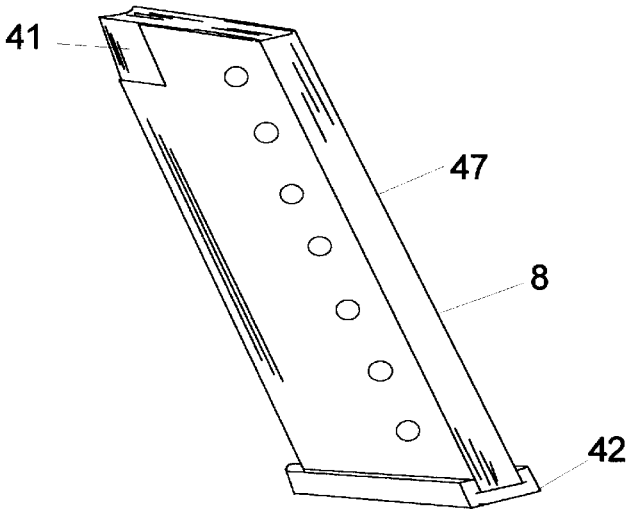
FIG. 2 is a perspective view of a typical magazine used in pistols.
Figure 3:
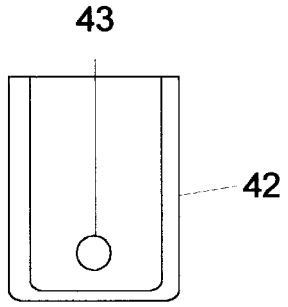
FIG. 3 is a top view of a typical magazine floor plate.
Figure 4:
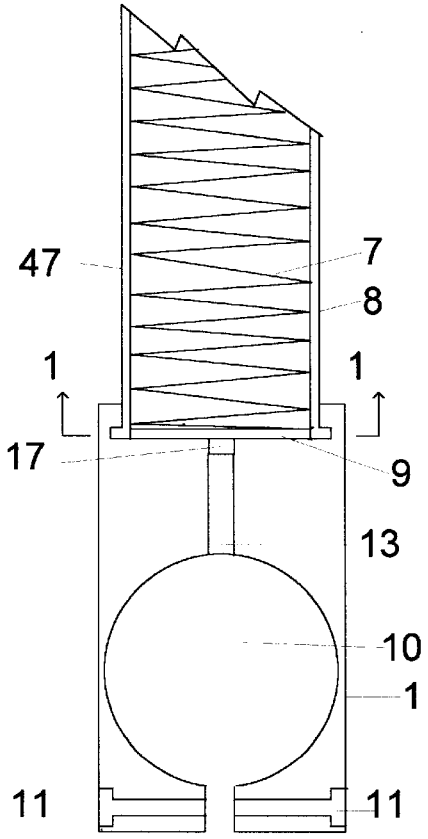
FIG. 4 is a front cross sectional view of a typical outside flange type pistol magazine with the original magazine floor removed, and an embodiment of the invention installed.
Figure 5:
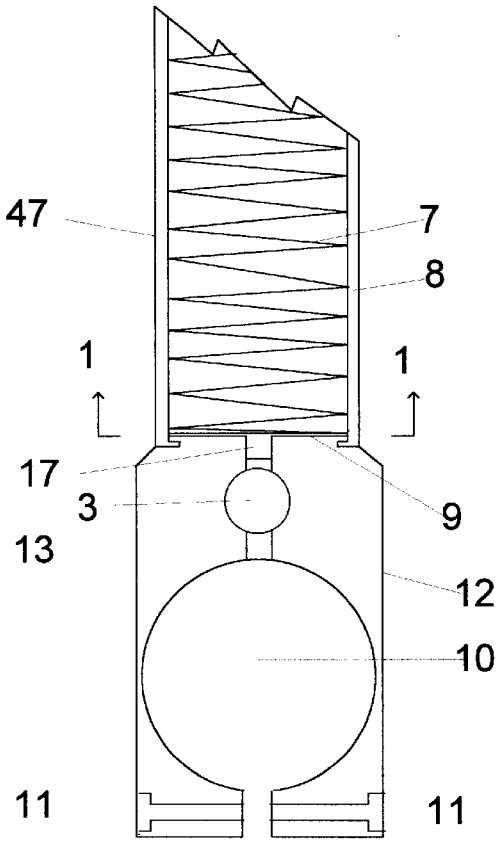
FIG. 5 is a front cross sectional view of a typical inside flange type pistol magazine with the original magazine floor removed, and an embodiment of the invention installed.
Figure 6:
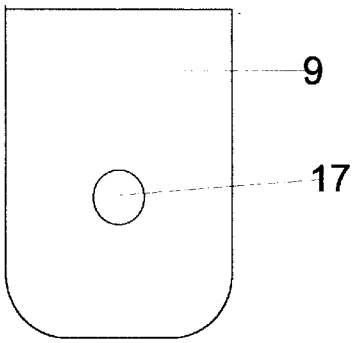
FIG. 6 is a top view of a typical magazine spring seat(insert).
Figure 7:
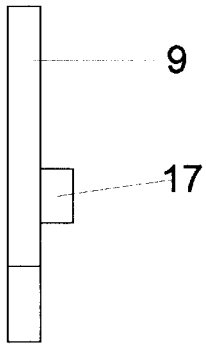
FIG. 7 is a side view of FIG. 6.

The pistol 6 includes a stock or hand grip 38, within which is housed the pistol's magazine 47 shown in FIGS. 2, 4 and 5. The magazine 47, consists of a case 8, a follower 41, a floor plate 42, and internally, a magazine spring 7, and a magazine seat or insert 9. The function of the magazine 47 is to hold the bullets for the firearm 6, and for the follower 41 to feed those bullets to the firing chamber from the magazine after the trigger 53 is pulled and the pistol cycles after firing. The bullets are forced by the follower 41, under tension from the magazine spring 7, to the top of the magazine 47. The magazine spring 7 is retained in place by a magazine spring seat or insert 9, which is locked in place by the magazine floor plate 42. FIG. 3 shows the magazine floor plate 42 with the key lock hole 43, within which the magazine spring seat lock key 17, as shown in FIG. 6 and FIG. 7 snaps into after the magazine floor plate is slipped on and over the base of the magazine flanges as shown by section 1-1 in FIGS. 4 and 5.

This embodiment, and all pistol adaptations of the invention makes exclusive use of the locking feature inherent in all configurations of pistol magazines regardless of firearm's manufacturer; namely, the replacement of the original magazine floor plate 42 with an embodiment mount of the invention, which has a key lock hole 13, for all types of pistols 6. Another important feature of all pistol mount embodiments is the mount-to-magazine interface 56, which is angled to give a firearm a projectile/flashlight illumination impact point 25 feet (7.622 meters) from the pistol firing position.

There are two types of magazines in use by firearm manufacturers, one which has an outside flange as shown in FIG. 4, and the other, as shown in FIG. 5, which has an inside flange over which the magazine floor plate 42 slips and then locks. In addition, the overall dimensions of magazines vary from manufacturer to manufacturer, based on pistol model and type. To cover the wide range of magazine types in use, or which may be put into use in the future, this invention has a broad range of mount embodiments available; however, all mounts that are available, or that will be available in the future, fit into two classifications as shown in FIGS. 4, 5, 8 and 9, namely those that fit a magazine with an outside flange as shown in FIG. 4, section 1-1 and in FIG. 8, and those that fit an inside flange as shown in FIG. 5, section 1-1 and in FIG. 9. In either case the magazine floor plate 42 is removed and the outside flange type mount 1, or the inside flange type mount 12, is installed and locked in place using the original O.E.M. magazine spring seat or insert 9 with the magazine spring seat lock key 17 forced into the receptacle hole 13 of the magazine by the magazine spring 7. Once the magazine spring seat lock key 17 is seated in the magazine hole 13, it cannot be dislodged and can only be removed by inserting into the magazine hole 13, an object small enough, such as a screw driver, that will allow the magazine spring seat lock 17 to be compressed to the point that it is clear of the mount hole 13 and will allow the mount to be slipped off.

Figure 8:
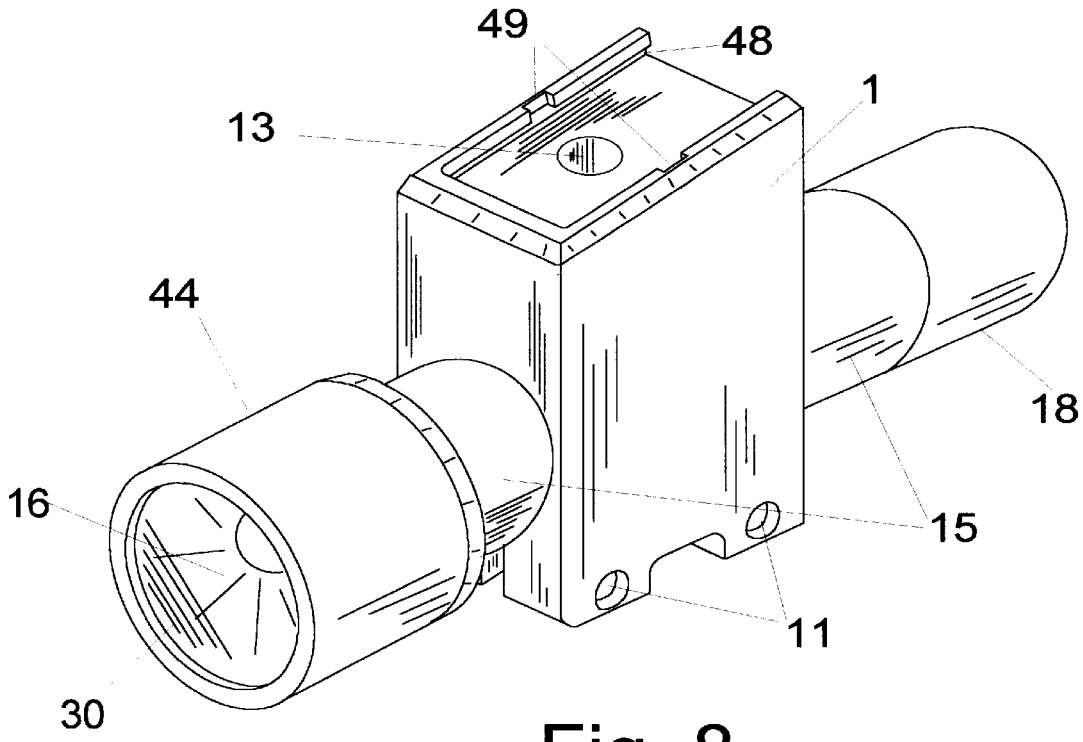
FIG. 8 is a top, front, left side perspective view of an embodiment of the invention that may be used to replace the original floor plate of an outside flange type pistol magazine.
Figure 9:
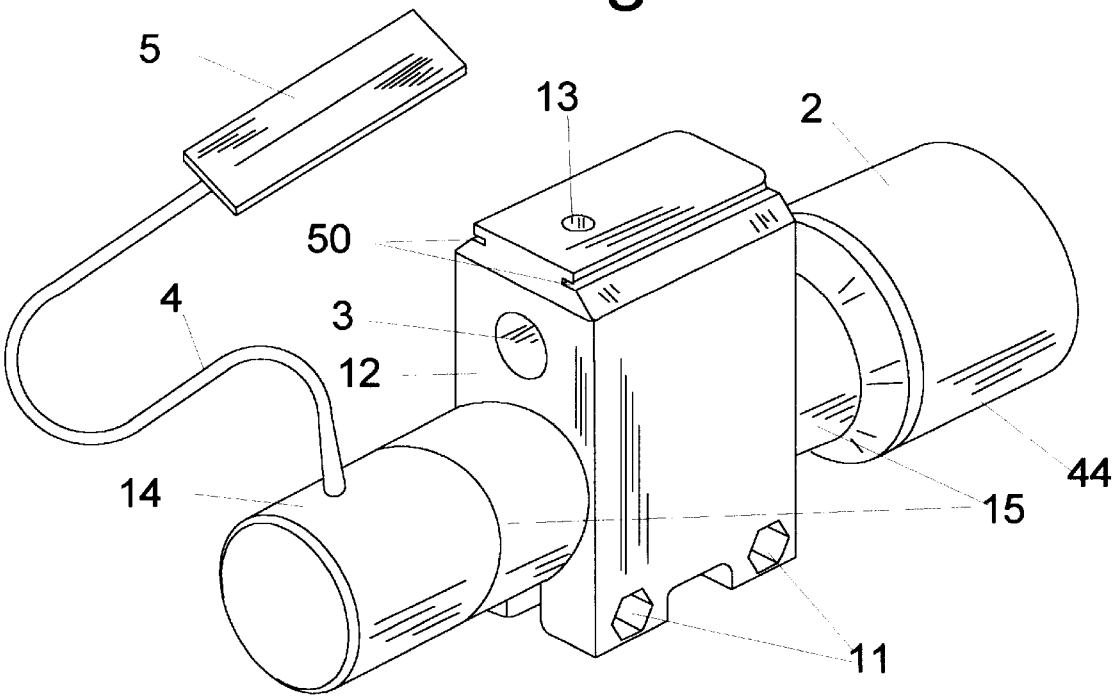
FIG. 9 is a top, rear, right side perspective view of an embodiment of the invention that may be used to replace the original floor plate of an inside flange type pistol magazine.

An embodiment of the flashlight 44 may be inserted through the circular hole 10 of mount 1 or mount 12 as shown in FIGS. 4 and 5, and locked in place by tightening the two socket head cap screws (SHCS) 11 in sequence until the mount is compressed tightly around the flashlight case 15. Two different embodiments of the flashlight and flashlight mount are depicted in FIGS. 8 and 9. One embodiment of the mount also provides a cavity 3 that may be used to insert a laser aiming assembly.

The embodiment of FIG. 8 clearly shows the slot 48 into which a magazine with an outside flange, as shown in FIG. 4, section 1-1, slips into. Also shown in FIG. 8 are the magazine spring seat key hole 13, and the key slot 49 that Glock type pistol magazines use as an additional magazine floor plate lock, to lock the mount 1 to the magazine 47. The flashlight 44 embodiment of FIG. 8 is illustrated with the turn/push end cap 18 that allows the user the capability to keep the flashlight 44 on continuously by turning the end cap 18 fully clockwise, which completes the electrical circuit and allows current to flow from the batteries, located in the flashlight body 15 to the Xenon bulb located in the lens assembly 16, or the capability to operate the flashlight 44 intermittently by rotating the end cap 18 counter clockwise a quarter of a turn after having turned the light on, which then disrupts the flow of electrical current to the Xenon bulb. The flashlight 44 will remain off until the user touches the end cap 18 at any location on the end cap 18, thereby completing the electrical path to allow current to flow from the batteries to the Xenon bulb, as long as the end cap 18 continues to be pressed or touched. The tolerance of the end cap 18 internal screw threads 52 shown in FIG. 10 are such that they allow the end cap 18, the spacer 19, the center contact 21, and the washer 51 to form a switching circuit and thereby become the switch for the turn/push end cap 18.

The embodiment of FIG. 9 shows the slot 50 into which the magazine 47 with an inside flange, as shown in FIG. 5, section 1-1, slips into. Also shown in FIG. 9 are the magazine spring seat key hole 13 and the laser cavity 3. The flashlight 44 embodiment of FIG. 9 is illustrated with a remote pressure switch end cap 14. The flashlight 44 is activated by exerting pressure on the remote switch 5. When the contacts of the remote switch 5 close, the electrical circuit in the flashlight 44 is closed and current flows from the batteries housed in the flashlight body 15, to the Xenon light bulb located in the lens assembly 16.

Figure 10:
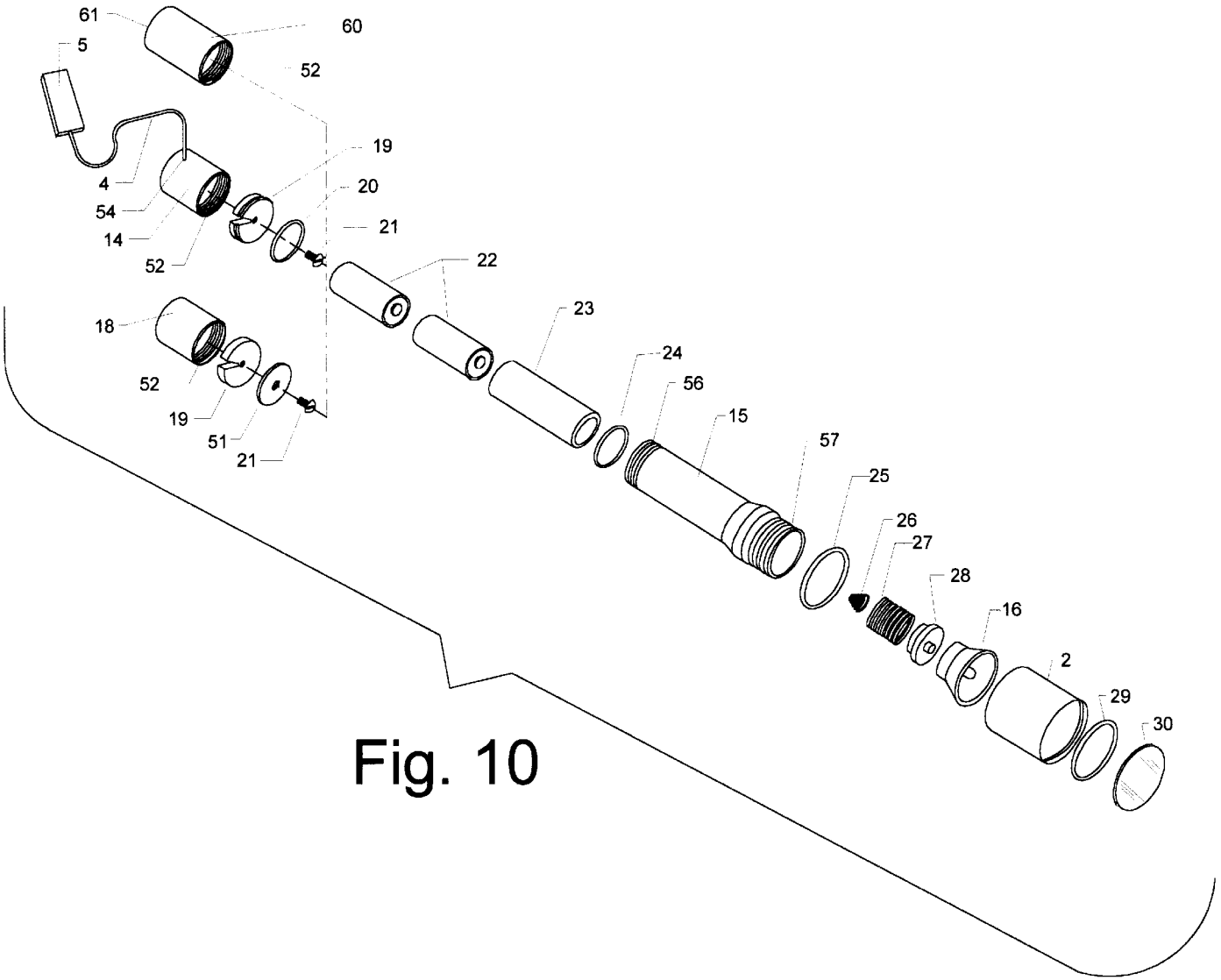
FIG. 10 is an exploded view of the flashlight embodiment of the invention.

The exploded view of FIG. 10 shows two embodiments of the flashlight 44. The remote pressure switch embodiment consists of the end cap 14 with the two conductor insulated wire 4 and the remote pressure switch 5, the spacer 19, the spring washer 20, the center contact 21, the batteries 22, the body conducting insert 23, the end cap 14 to flashlight body 15 O-ring seal 24, the flashlight body 15, the flashlight body 15 to lens assembly 2 O-ring seal 25, the lens assembly center contact spring 26, the lens assembly outside contact spring 27, the lens assembly insulated seat 28, the lens reflector and Xenon bulb assembly 16, the lens assembly cover 2, the lens cover 2 to lens 30 O-ring seal 29, and the lens 30.

The O-ring seal 24 is inserted over the end cap end of the flashlight body 15 into a ridge provided for it to provide a water tight seal when the end cap 14 is screwed onto the flashlight body 15. The O-ring seal 25 is inserted over the lens assembly cover end of the flashlight body 15 and seated into a ridge provided for it in order to provide a water tight seal when the lens cover assembly 2, which has internal eight start threads, is screwed onto the flashlight body 15, which has eight start threads 57. The lens cover to lens O-ring seal 29 is inserted into a ridge provided for it in the lens cover 2 and the lens 30 is pressed on to the lens assembly 2 and the O-ring seal 29 to provide a water tight seal.

The electrical circuit of this embodiment consists of each contact of the remote switch 5 connected individually to each wire of the two insulated coated wires that make up the insulated covered wire 4. The pressure switch 5 consists of two strips of conductive metal of copper composition. Said strips are kept apart by the spring action of said strips, the non-conducting plastic material placed between said strips, and the water proof plastic sleeve that covers and holds in place said strips and said non-conducting plastic, and seals the pressure switch 5 and the wire 4. The other end of the wire 4 is inserted through the end cap 14 hole 54 with one wire being soldered to the center contact 21, which is seated into the spacer 19, and the other wire soldered to the spring washer 20, which is then snapped onto the perimeter of the spacer 19. The spacer 19 with its attachments of the center contact 21, the spring washer 20, and the wire 4 are snapped into the base of the end cap 14. A silicon sealant is applied to the spacer 19, the wire 4 and hole 54 to provide a bond to protect the wire 4 from being pulled out of hole 54, and to make hole 54 water resistant. The body conducting insert 23 is pressed into the flashlight body 15, which is of a hollow construction, to provide a conducting path through the flashlight body 15. When the end cap 14, which has internal threads 52, is screwed onto the flashlight body 15, which has external threads 56, not only is a water tight seal made because of the O-ring seal 24, but electrical contact between the spring washer 20 and the body conducting insert 23 is made. The batteries 22 are inserted into the body conductor 23 and provide electrical power and the electrical path from the center contact 21, through the battery center contact to the front lens assembly center contact spring 26.

The lens assembly insulation seat 28 has two small holes through which the leads from the Xenon bulb in the lens reflector and Xenon bulb assembly 16 are inserted. The lens assembly insulation seat 28 is permanently attached to the lens reflector and Xenon bulb assembly 16 with epoxy. The lens assembly center contact spring 26 is snapped onto the lens assembly insulated seat 28 and one lead of the Xenon bulb welded to the lens assembly center contact spring 26. The lens assembly outside contact spring 27 is snapped onto the lens assembly insulation seat 28 and the remaining lead of Xenon bulb welded to the lens assembly outside contact spring 27. The total lens assembly, consisting of the lens assembly center contact spring 26, the lens assembly outside contact spring 27, the lens assembly insulation seat 28 and the lens reflector and Xenon bulb assembly 16, is inserted into the lens cover 2, which is made up of the lens cover 2, the O-ring seal 29, and the lens 30. The lens cover 2 is then screwed onto the flashlight body 15 and with the O-ring seal 25 forms a water tight seal. The electrical path to the Xenon bulb from the center battery contact is made through the lens assembly center contact spring 26 and from the body conductor 23 through the lens assembly outside contact spring 27. Two important features of the total lens assembly, made up of the lens assembly center contact spring 26, the lens assembly outside contact spring 27, the lens assembly insulation seat 28 and the Xenon bulb assembly 16, are that the lens assembly Xenon bulb will not fail, even when continuously exposed to the high G-forces experienced when a firearm is fired, and the bulb reflector (parabolic) design provides the capability for projecting a brilliant beam of white light.

The turn/push flashlight embodiment consists of the end cap 18, the spacer 19, the conductive washer 51, with remaining flashlight elements being the same as explained for the remote pressure switch embodiment. The end cap 18 is of solid continuous construction with internal threads 52, and when screwed onto the flashlight body 15 with external threads 56, provides a water tight seal. The washer 51 is firmly attached to the spacer 19 using the center contact 21, and provides the electrical path for current flow when the end cap 18 is closed fully clockwise.

Another variation of the turn/push flashlight embodiment consists of the extended length end cap 60, which is of solid aluminum construction with threads taped into both ends, but with a solid center core. The remaining flashlight elements are the same as explained for the remote pressure switch embodiment. One end of end cap 60 is provided with internal threads 52, and when screwed onto the flashlight body 15 with external threads 56, provides a water tight seal and a continuous electrical path. The threads 61 on remaining end of end cap 60 provide the capability for attaching the turn/push flashlight to an array of devices having corresponding mating threads, such as the ASP police baton. The flashlight is turned on or off by rotating lens assembly cover 2 clockwise or counter clockwise respectively.

Figure 11:
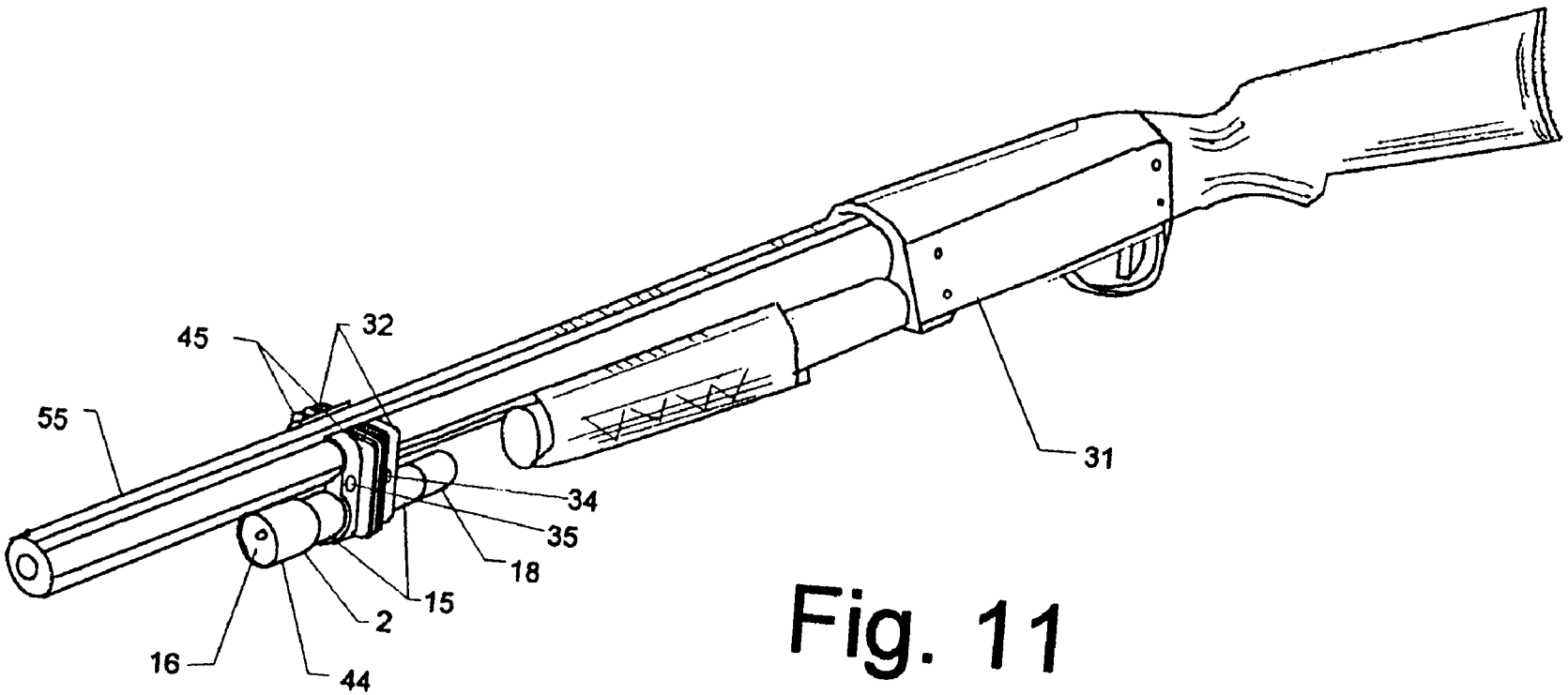
FIG. 11 is a top, front, left side perspective view of a long gun upon which has been installed an embodiment of the invention.
Figure 12:
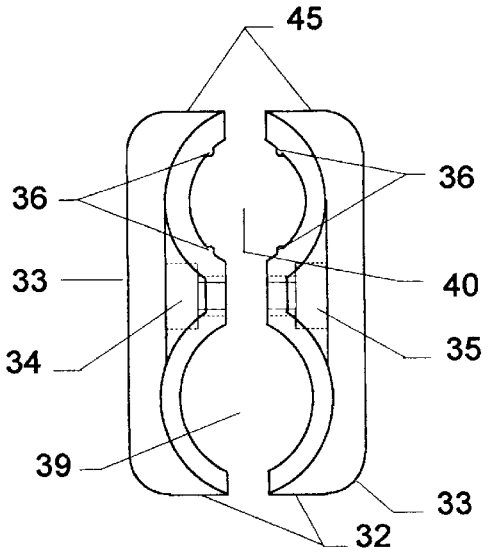
FIG. 12 is a front view of an embodiment of the invention that is used to mount the illuminating device to a long gun.
Figure 13:
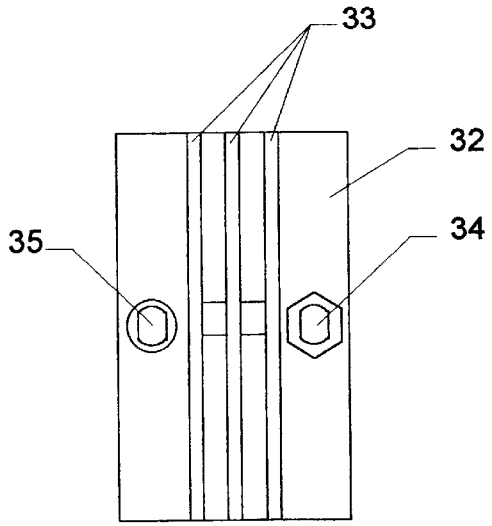
FIG. 13 is a side view of FIG. 12.
Figure 14:
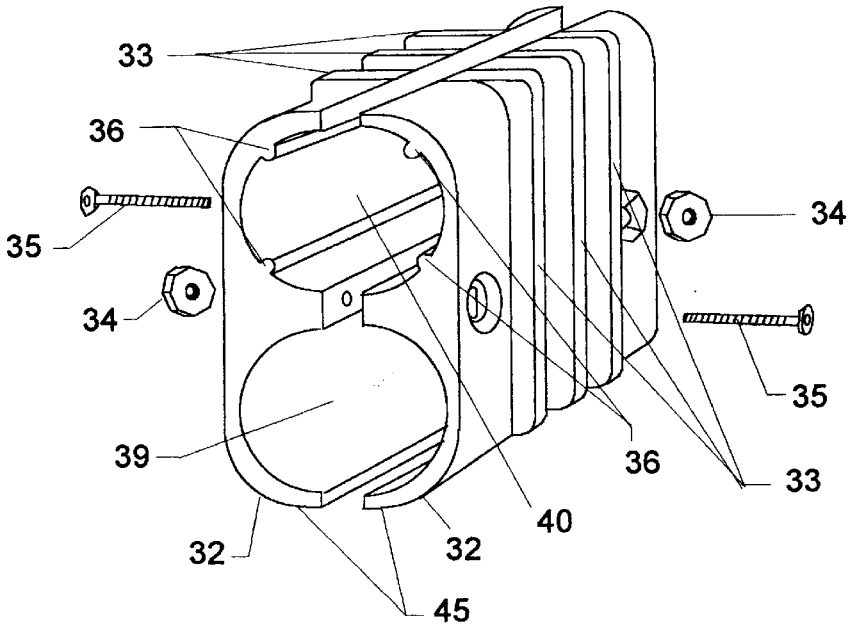
FIG. 14 is a top, front, left side perspective view of FIG. 12.

The embodiment of FIG. 11 illustrates yet another mount configuration using the universal mount 45 with the flashlight 44, mounted on a long firearm 31. FIG. 12 shows the universal mount 45, which consists of two identical mount halves 32, with the screw holes 34 and 35. FIG. 13 shows the strengthening fins 33 and the nut hole 34 and the screw hole 35. The long firearm barrel 55, but not excluding any other device having a diameter between ¾ to 1¼ inches, is inserted in the opening 40 between the mount halves 32. The flashlight 44 is inserted in the opening 39. The flashlight may be of either embodiment previously discussed. Two screws 35 and two nuts 34 shown in FIG. 14 are inserted through the corresponding openings 34 and 35 of the mount halves 32 and sequentially tighten down until the mount 45 is secured to the barrel 55 and the flashlight 44 secured to the mount 45. Four extrusions 36 aid in keeping the mount 45 secured to the long gun barrel 55 so that the G-forces experienced when the firearm is fired will not cause the mount 45 to move around on the barrel 55.

Figure 15:
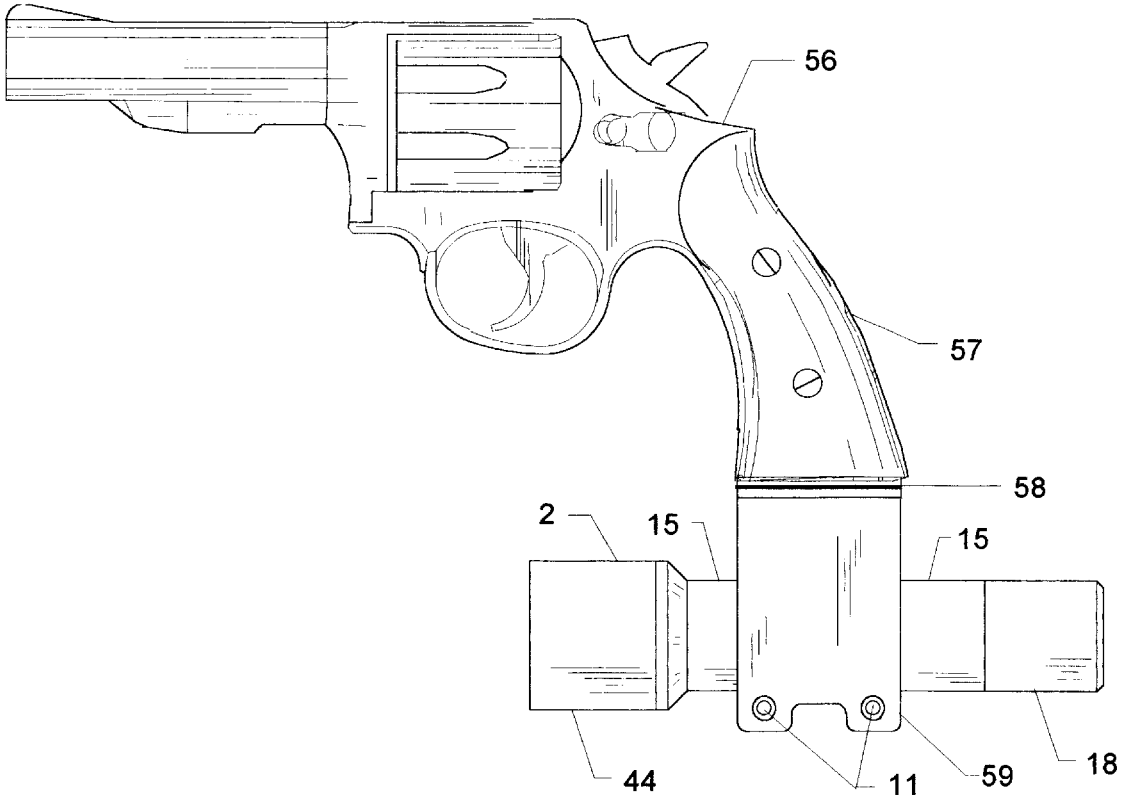
FIG. 15 is a side view of a revolver upon which has been installed an embodiment of this invention.

The embodiment of FIG. 15 shows the mount 59, whose interface to the firearm is a flat surface, attached to the revolver 56, and in particular to the revolver's grip butt 57 at the flat surface of the butt end. The mount 59 may be attached to the butt 57 using hook and loop Velcro 58 attachments. Either embodiment of the flashlight 44 may be attached to the mount 59 by inserting it through the cavity provided for it and locked in place by tightening the two socket head cap screws (SHCS) 11.

Although some embodiments of the invention have been described, it will be understood by those knowledgeable and skilled in the firearms field, that modifications may be made to the disclosed embodiments without departing from the scope of the invention which is defined by the following claims.

We claim:

1. A handgun in combination with a mounting device comprising:

(a) said handgun having a handgrip wherein said handgrip contains a magazine for holding ammunition; said magazine including a magazine spring and follower and a magazine spring seat; said magazine spring seat located at the bottom of the magazine and including an extending lock key;

(b) said mounting device mounting either a flashlight or laser to said firearm; said mounting device being attached to the bottom of the handgrip adjacent the magazine; said mounting device including a mount with a lock key aperture that receives the extending lock key when the mounting device is attached to the handgun; said mounting device further comprising flanges that extend along an upper portion of the mount; wherein said flanges interconnect with structure on a lower portion of the magazine to attach said mounting device to the handgun.

2. The handgun in combination with a mounting device as claimed in claim 1 further comprising:

(c) a switch attachable to the handgrip for activating and deactivating either said flashlight or said laser.

3. The handgun in combination with a mounting device as claimed in claim 1 wherein said mount contains an opening for either said flashlight or said laser with said mount further comprising screw holes and screws for fixedly attaching either said flashlight or said laser to the mount.

4. The handgun in combination with a mounting device as claimed in claim 1 wherein said flanges contain either an inside flange or an outside flange relate to the mount.

* * * * *